US008251716B2

(12) United States Patent
Chen

(10) Patent No.: US 8,251,716 B2
(45) Date of Patent: Aug. 28, 2012

(54) ELECTRICAL CONNECTOR HAVING SIMILARLY SHAPED CONTACTS INSERTED IN DIFFERENT DIRECTIONS

(75) Inventor: De-Jin Chen, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 12/945,906

(22) Filed: Nov. 15, 2010

(65) Prior Publication Data

US 2011/0300762 A1 Dec. 8, 2011

(51) Int. Cl.
*H01R 12/00* (2006.01)

(52) U.S. Cl. ..... 439/79; 439/682

(58) Field of Classification Search ..... 439/79, 439/682

See application file for complete search history.

(56) References Cited

U.S. PATENT DOCUMENTS 3,907,392 A * 9/1975 Haag et al. ..... 439/218
5,186,633 A * 2/1993 Mosser, III ..... 439/79
5,921,789 A * 7/1999 Makino et al. ..... 439/79
6,045,372 A * 4/2000 Lian et al. ..... 439/83
6,939,168 B2 * 9/2005 Oleynick et al. ..... 439/541.5

FOREIGN PATENT DOCUMENTS

CN 201285856 8/2009

* cited by examiner

*Primary Examiner* — Gary f. Paumen

(74) *Attorney, Agent, or Firm* — Wei Te Chung; Andrew C. Cheng; Ming Chieh Chang

(57) ABSTRACT

An electrical connector is mated with a counter connector in an inserting direction. The electrical connector includes an insulative housing and two rows of contacts inserted into the insulative housing in two opposite directions parallel to the inserting direction. The insulative housing defines two rows of receiving passageways arranged in a height direction perpendicular to the inserting direction. Each contact received in the receiving passageway defines a base portion, a pair of retaining portions extending from the base portion, a pair of elastic arms extending from the pair of retaining portions and a soldering portion extending from the base portion. All the contacts have a same shape expect lengths of the soldering portions.

17 Claims, 4 Drawing Sheets

ELECTRICAL CONNECTOR HAVING SIMILARLY SHAPED CONTACTS INSERTED IN DIFFERENT DIRECTIONS

BACKGROUND OF THE INVENTION

1. Field of the Invention

The present invention relates to an electrical connector, and more particularly to an electrical connector having similarly shaped contacts inserted in different directions.

2. Description of the Related Art

CN Patent No. 201285856 issued on Aug. 5, 2009 discloses an electrical connector. The electrical connector includes an insulative housing and two rows of contacts arranged in a height direction. Each contact defines a base portion and a pair of elastic arms extending from at front lateral edges of the base portion. The pair of elastic arms extends inwards slantwise to define a receiving open therebetween from which contacts of a counter connector are inserted. An upper row of contacts further includes soldering portions extending from rear ends of the base portions while a lower row of contacts further includes soldering portions extending from front ends of the base portions. The soldering portions of the upper row of contacts and the lower row of contacts are located at two opposite sides of the insulative housing to secure the electrical connector to a print circuit board better. The upper row of contacts and the lower row of contacts of different shapes make a manufacture process of the contacts complicated.

In view of the above, a new electrical connector that overcomes the above-mentioned disadvantages is desired.

SUMMARY OF THE INVENTION

Accordingly, an object of the present invention is to provide an electrical connector having similarly shaped contacts inserted in different directions.

To fulfill the above-mentioned object, an electrical connector is mated with a counter connector in an inserting direction. The electrical connector includes an insulative housing and two rows of contacts inserted into the insulative housing in two opposite directions parallel to the inserting direction. The insulative housing defines two rows of receiving passageways arranged in a height direction perpendicular to the inserting direction. Each contact received in the receiving passageway defines a base portion, a pair of retaining portions extending from the base portion, a pair of elastic arms extending from the pair of retaining portions and a soldering portion extending from the base portion. All the contacts have a same shape expect lengths of the soldering portions.

Other objects, advantages and novel features of the invention will become more apparent from the following detailed description when taken in conjunction with the accompanying drawings.

DETAILED DESCRIPTION OF THE PREFERRED EMBODIMENT OF THE INVENTION

Reference will now be made to the drawings to describe the present invention in detail.

Figure 1:
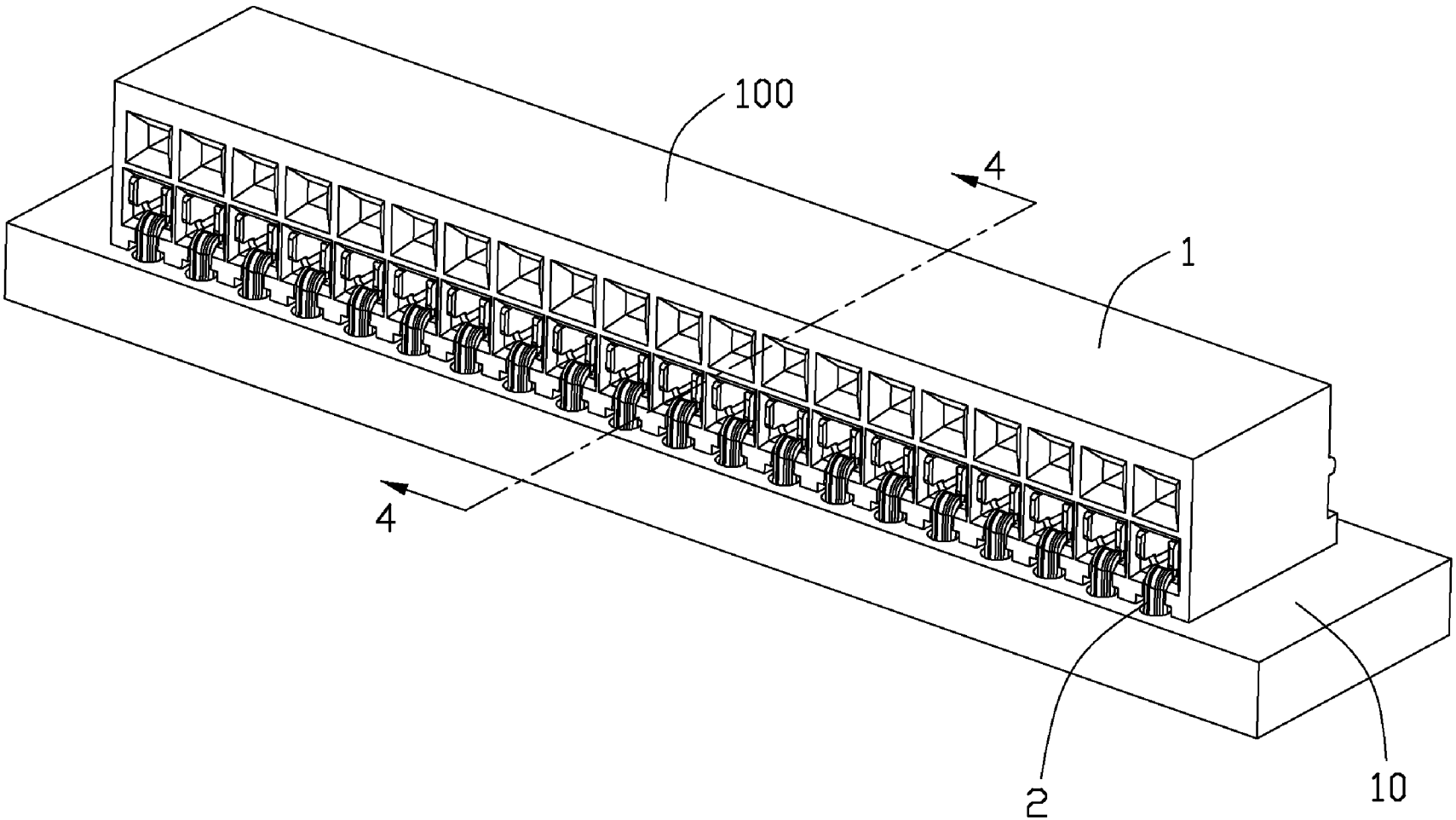
FIG. 1 is a top and front perspective view of an electrical connector fixed to a print circuit board.
Figure 2:
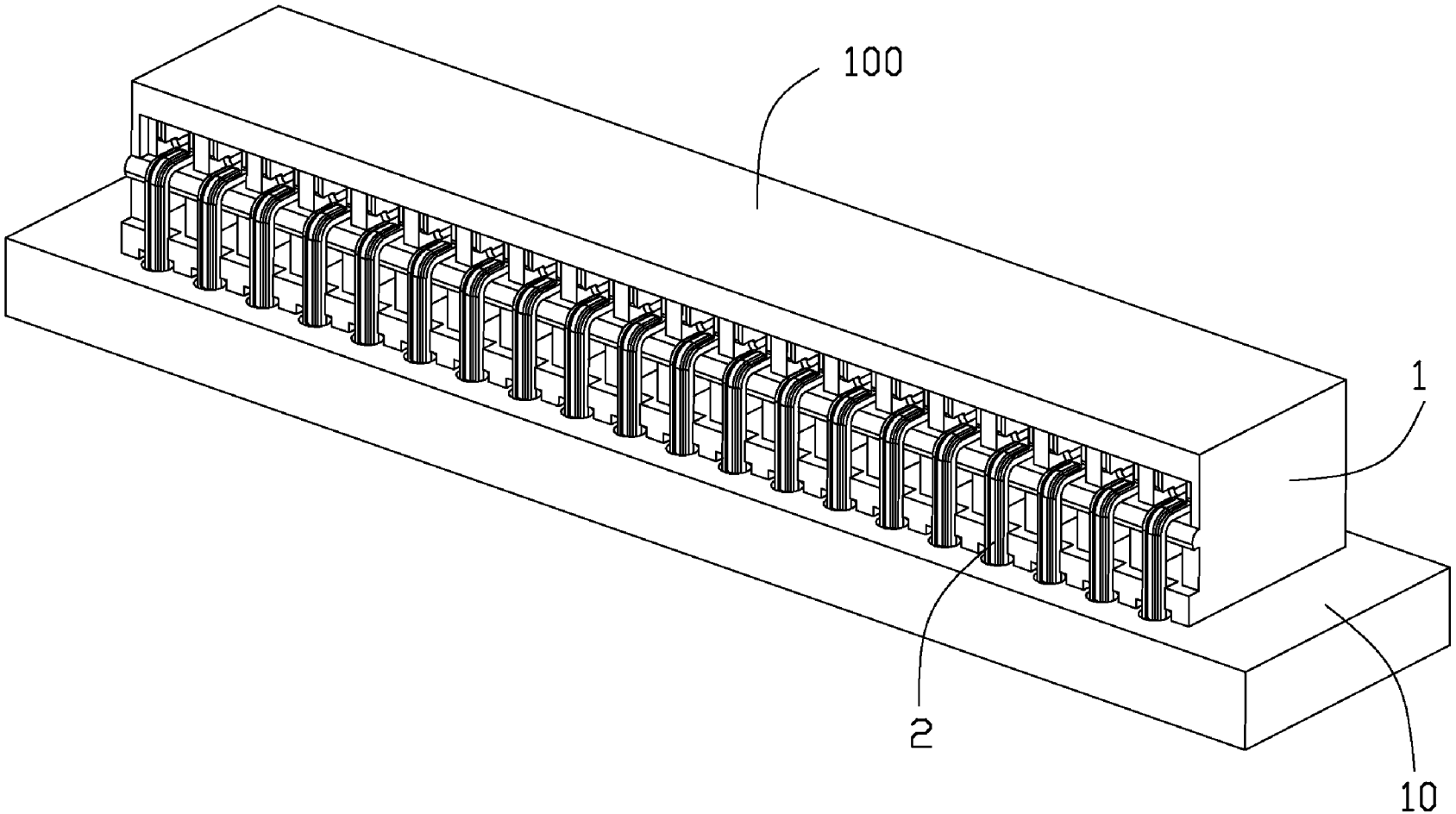
FIG. 2 is a top and rear perspective view of the electrical connector fixed to the print circuit board.

Referring to FIGS. 1-2, an electrical connector 1 of the present invention is fixed to a print circuit board 10, which comprises an insulative housing 1 and a plurality of contacts 2 received in the insulative housing 1.

Figure 3:
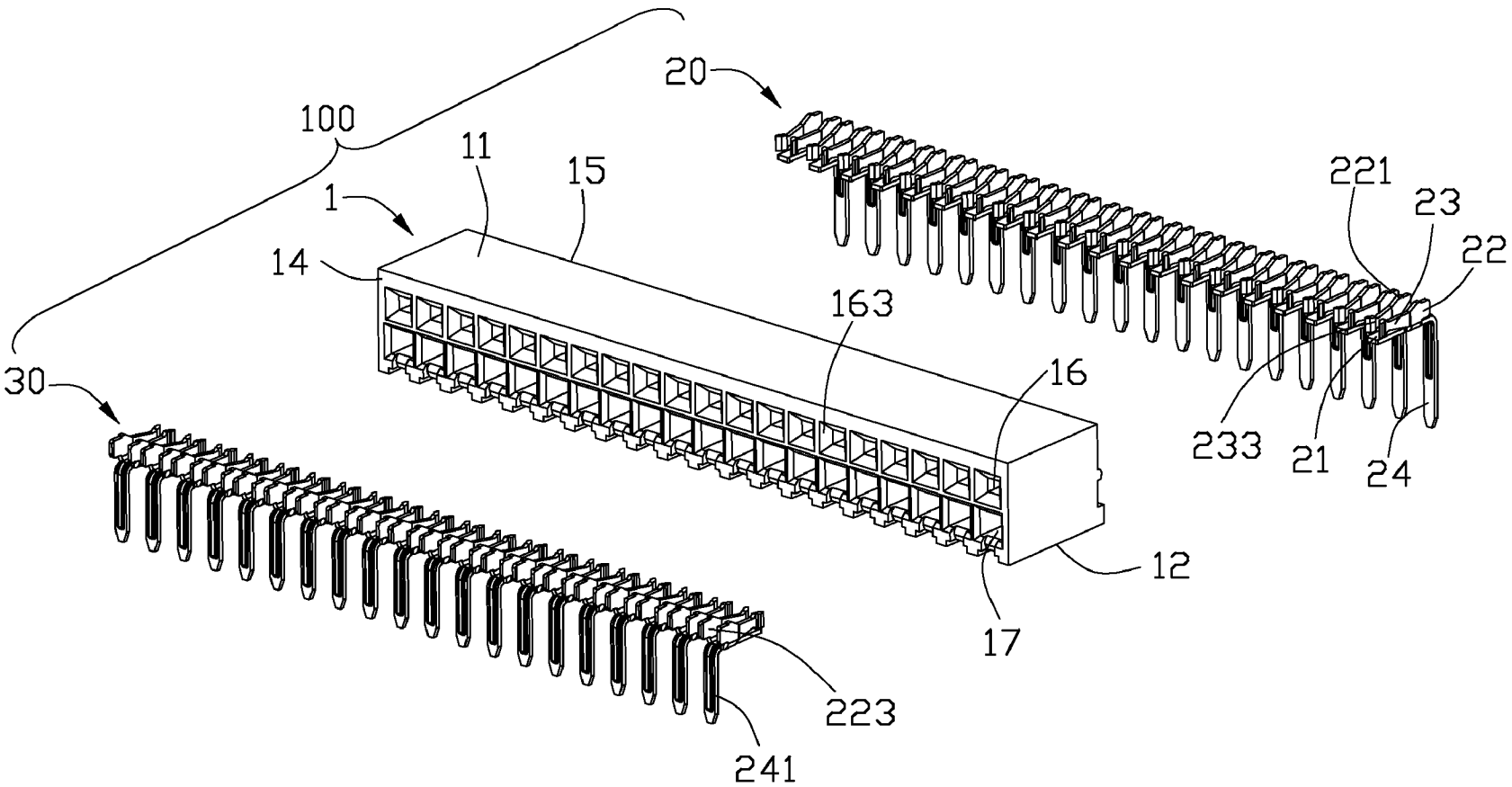
FIG. 3 is an exploded view of the electrical connector of FIG. 1.
Figure 4:
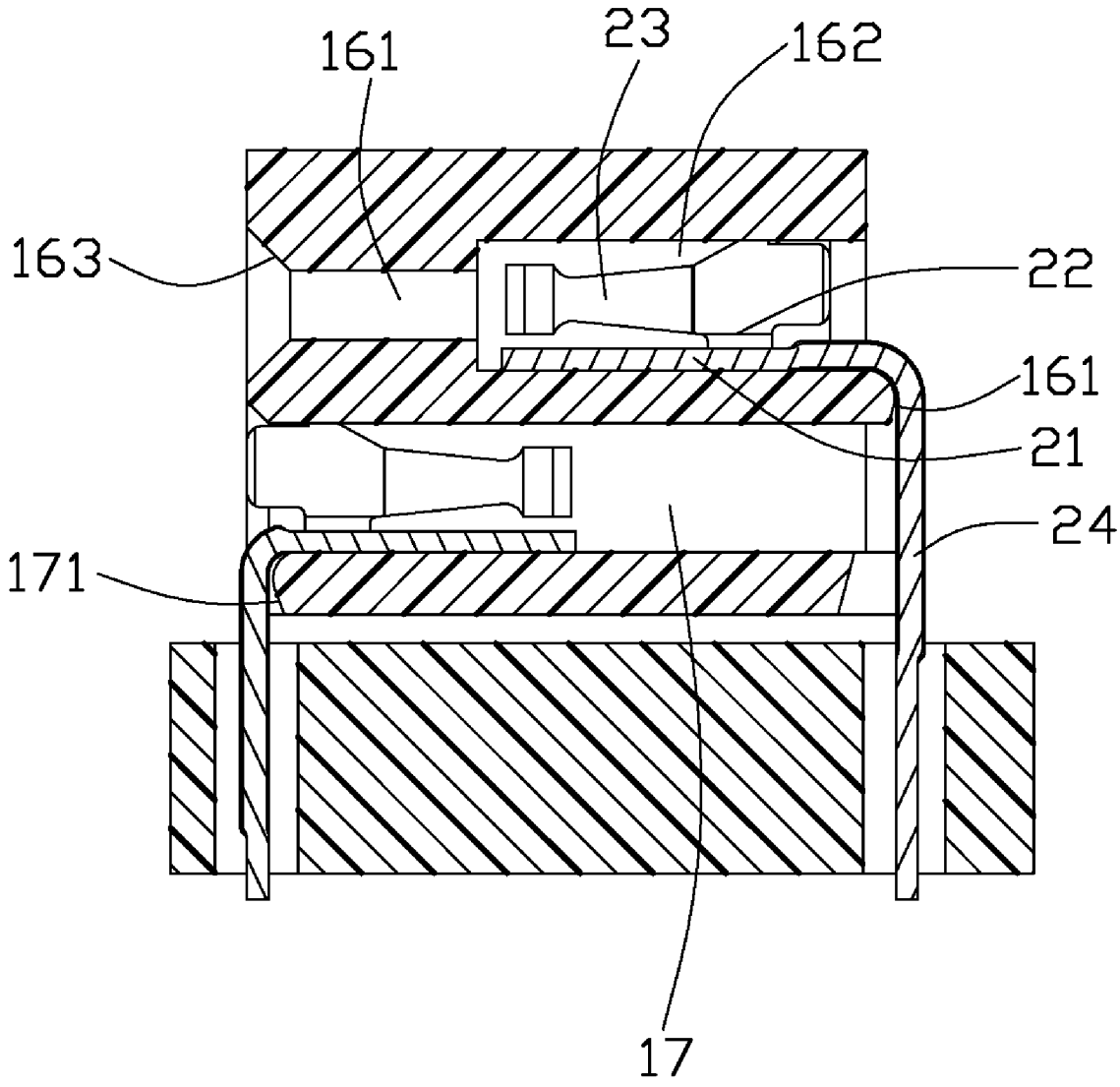
FIG. 4 is a cross sectional view of the electrical connector taken along line 4-4 in the FIG. 1.

Referring to FIG. 3, the insulative housing 1 defines a front mating face 14, a rear face 15 opposite to the front face 14, and a top face 11 and a bottom mounting face 12 bridging the front face 14 and the rear face 15. The bottom face 12 resists on the print circuit board 10. The insulative housing 1 defines two rows of receiving passageways arranged in a height direction, i.e. an upper row of receiving passageways 16 and a lower row of receiving passageways 17 parallel to the upper row of receiving passageways 16. The two rows of receiving passageways respectively run through the front face 14 and the rear face 15. Referring to FIG. 4, each upper receiving passageway 16 includes a first cavity 161 close to the front face 14 and a second cavity 162 communicating with the first cavity 161 close to the rear face 15. The second cavity 162 is wider than the first cavity 161 in the height direction. Each upper receiving passageway 16 defines a plurality of guiding faces 163 at the front face 14. Each lower receiving passageway 17 has a same width in the height direction substantially equal to the second cavity 162.

Referring to FIG. 3, the contacts 2 comprise an upper row of contacts 20 and a lower row of contacts 30 parallel to the upper row of contacts 20. The upper contacts 20 are inserted in the upper receiving passageways 16 from the rear face 15 along a reverse-inserting direction opposite to an inserting direction of a counter connector and just received in the second cavity 162. The lower contacts 22 are inserted in the lower receiving passageways 17 from the front face 14 along the inserting direction.

Each contact 2 defines a base portion 21 extending in the inserting direction, a pair of retaining portions 22 perpendicularly extending upward from two opposite sides of the base portion 21, a pair of elastic arms 23 extending from the pair of retaining portions 22 and a soldering portion 24 extending downward from the base portion 21. The retaining portions 22 and the soldering portion 23 of all the contacts 2 extend from a same end of the base portion 21. A first side of the retaining portion 22 connects with the base portion 21 and a second side opposite to the first side defines a plurality of barbs 221. The contacts 2 are fixed to the insulative housing 1 by the barbs 221 of the contacts 2. A rib 241 protrudes from one side of the soldering portion 24 to enforce intensity. The base portion 21 and the soldering portion 24 are configured with a reversal L-shaped manner. Please notes as shown in FIG. 4, the two retaining portions 22 of every pair are parallel to each other and form a first open 223, the first opens 223 of the lower contacts 30 are located in vicinity of the front face 14 so that the contacts of the counter connector are inserted through the first opens 223 and then clipped by the pair of elastic arms 23. The first opens 223 of the upper contacts 20 are located in vicinity of the rear face 15 so the contacts of the counter connector are clipped by the pair of elastic arms 23 of the upper contacts 20 firstly. The two elastic arms 23 of every pair slant to each other to define a second open 233, the second opens 233 of the upper contacts 20 faces forward in the second cavity 162 so that the contacts of the counter connector are inserted in the second open 233 and clipped by the pair of the elastic arm 23 through the first cavity 161. The second opens 233 of the lower contacts 30 faces backward. When the upper contacts 20 are turned reversely in condition that the elastic arms 23 and the base portions 21 of the upper contacts 20 orient as the elastic arms 23 and the base portions 21 of the lower contacts 30, it will found that the upper and the lower contacts have a same shape expect lengths of the soldering portions 24. The structures of the contacts 2 simplify a manufacture process, especially in mold.

The upper receiving passageways 16 and the lower receiving passageways 17 respectively define contacting faces 161, 171 of arc shape at the rear face 15 and the front face 14. The soldering portions 24 lean against the contacting face 161, 171 to prevent from destroying the contacts 2.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector mated with a counter connector in an inserting direction, comprising:

an insulative housing defining two rows of receiving passageways arranged in a vertical direction perpendicular to the inserting direction;

two rows of contacts inserted into the receiving passageways in two opposite directions parallel to the inserting directions, each contact defining a base portion, a pair of retaining portions extending from the base portion, a pair of elastic arms extending from the pair of retaining portions and a soldering portion extending from the base portion;

wherein all the contacts have a same shape except lengths of the soldering portions;

wherein lower contacts of said two rows of contacts are inserted in lower passageways of said two rows of receiving passageways from a first face of the insulative housing while upper contacts of said two rows of contacts are inserted in an upper row of receiving passageways from a second face opposite to the first face;

wherein the elastic arms define contacting portions to touch with the counter connector, the contact portions of all the contacts are aligned with each other not only in each row but also in the vertical direction.

2. The electrical connector as claimed in claim 1, wherein the soldering portions of said two rows of contacts bending from a front edge of the base portions.

3. The electrical connector as claimed in claim 2, wherein the upper row of receiving passageways includes a first cavity close to the first face and a second cavity communicating with the first cavity close to the second face, the second cavity is wider than the first cavity in the height direction; each of the lower row of receiving passageways has a same width in the height direction which is substantially equal to the second cavity.

4. The electrical connector as claimed in claim 3, wherein the upper contacts are just received in the second cavities, not extending to the first cavities.

5. The electrical connector as claimed in claim 1, wherein a rib protrudes from one side of the soldering portion and extends along the height direction.

6. The electrical connector as claimed in claim 5, wherein the upper receiving passageways and the lower receiving passageways respectively define contacting faces of arc shape, the soldering portions lean against the contacting faces.

7. The electrical connector as claimed in claim 1, wherein a first side of each retaining portion perpendicularly connects with the base portion and a second side opposite to the first side defines a plurality of barbs by which the contacts are retained in the insulative housing.

8. The electrical connector as claimed in claim 1, wherein the retaining portions and the soldering portion of each contact extend from a same end of the base portion.

9. The electrical connector as claimed in claim 8, wherein the retaining portions and the soldering portion of each contact are located at different sides of the base portion in the height direction.

10. An electrical connector comprising:

an insulative housing defining a front face for mating with a counter connector and a rear face opposite to the front face, a plurality of receiving passageways arranged in two rows running through the front face and the rear face;

two rows of contacts inserted in the receiving passageways, each contact defining a base portion, a pair of retaining portion forming a first open therebetween at a first end thereof, a pair of elastic arms slant to each other to form a second open at a second end and a soldering portion extending from said first end thereof;

wherein a first row of said two rows of contacts are disposed in condition that the soldering portions are along the front face and the first opens are in the vicinity of the front face and the second opens are face to the rear face while a second row of said two rows of contacts are disposed in condition that the soldering portions are along the rear face and the first opens are near to the rear face and the second opens face to the front face.

11. The electrical connector as claimed in claim 10, wherein said first rows are located above said the second row.

12. The electrical connector as claimed in claim 11, wherein the second opens of said two rows are substantially aligned with each other in a height direction perpendicular to the front face.

13. An electrical connector for mounting to a printed circuit board and for mating with a complementary connector having protruding terminals thereof, comprising:

an insulative housing defining upper and lower rows of passageways arranged in a transverse direction and each extending therethrough in a front-to-back direction, perpendicular to said transverse direction, between opposite front and rear faces of the housing wherein through the front face the protruding terminals of the complementary connector are allowed to extend into the corresponding passageways;

a plurality of upper row contacts and a plurality of lower row contacts disposed in the corresponding upper and lower rows of the passageways, respectively, each of said upper row contacts including an upper horizontal section securely received in the corresponding passageway in the upper row and an upper mounting section extending from the upper horizontal section and further downwardly and exposed around the rear face, each of said lower row contacts including an lower horizontal section securely received in the corresponding passageway in the lower row and a lower mounting section extending from the lower horizontal section and further downwardly and exposed around the front face, wherein the upper horizontal sections and the lower horizontal sections are essentially dimension and configured to be similar to each other but arranged in an mirror image with each other, while the upper mounting sections are longer than the lower mounting sections in a vertical direction perpendicular to said front-to-back direction and said transverse direction; wherein the upper row of passageways are configured to allow the corresponding upper row contacts to be assembled thereinto forwardly via the rear face of the housing while the lower row of passageways are configured to allow the corresponding lower row contacts to be assembled thereinto via the front face of the housing.

14. The electrical connector as claimed in claim 13, wherein a front portion of each of said upper row of passageways is narrowed to provide a guiding structure while that of the lower row of passageways is not.

15. The electrical connector as claimed in claim 13, wherein the upper row contact includes a retention structure located on the upper horizontal section around the rear face while the lower row contact includes another retention structure located on the lower horizontal section around the front face.

16. The electrical connector as claimed in claim 15, wherein the upper row contacts includes a mating structure located on the upper horizontal section in front of said retention structure, while the lower row contact includes another mating structure located on the lower horizontal section behind said another retention structure.

17. The electrical connector as claimed in claim 16, wherein said mating structure defines a mating position, and said another mating structure defines another mating position under condition both said mating position and said another mating position are located around a middle region between the front face and the rear face in said front-to-back direction.

* * * * *